United States Patent [19]

Smith et al.

[11] Patent Number: 4,994,075

[45] Date of Patent: Feb. 19, 1991

[54] INFANT PACIFIER HOLDER ASSEMBLY

[76] Inventors: Jeanne M. Smith; Virginia A. Buechler; Predrag Vukovic, all of 450 Cascade Dr., Fairfax, Calif. 94930

[21] Appl. No.: 385,210

[22] Filed: Jul. 25, 1989

[51] Int. Cl.[5] ..... A61J 17/00

[52] U.S. Cl. ..... 606/235; 24/301

[58] Field of Search ..... 606/234–236; 128/359, 360; D24/45–47; 24/67.9, 300, 301, 563; 446/28, 227, 486, 490

[56] References Cited

U.S. PATENT DOCUMENTS

| | | | |
|---|---|---|---|
| D. 295,558 | 5/1988 | Jefferson et al. | D24/45 |
| 447,164 | 2/1891 | Simpson | 606/235 |
| 1,331,654 | 2/1920 | League | 24/563 |
| 3,616,571 | 11/1971 | Adickes | 446/28 |
| 4,188,745 | 2/1980 | Harvey et al. | 446/227 |
| 4,765,037 | 8/1988 | Perry | 24/301 |

*Primary Examiner*—C. Fred Rosenbaum
*Assistant Examiner*—William W. Lewis
*Attorney, Agent, or Firm*—Owen, Wickersham & Erickson

[57] ABSTRACT

A sinusoidal plastic cord having a ring-like member at its proximate end which can be engaged by the ring or handle of an infant's mouth toy. This cord has distal end that engages a clip member which can be clipped to the clothes of an infant to anchor said combination of clip, cord and mouth toy, so that the mouth toy is retained from loss and from separation from the infant.

4 Claims, 2 Drawing Sheets

INFANT PACIFIER HOLDER ASSEMBLY

CROSS REFERENCE

This application is related to a design patent application filed the same day as this application by the same inventors. Said design patent application is entitled CLIP FOR USE WITH MOUTH TOY.

PRIOR ART STATEMENT

The prior art known to the inventors consists of a device described as a pacifier leash which is sold under the trademark "Paci-Keeper" by Marriott Concepts, Inc. of Orem, Utah.

This device includes three major pieces; a large hard plastic disk, a metal spring loaded clip, and a flat piece of cloth ribbon. The plastic disk is round and approximately two inches in diameter having a concave reverse and a convex obverse. Glued to the obverse is a plastic decoration depicting the head of an animal, such as a bear. On the reverse of the disk the metal spring loaded clip is attached by means of a metal eyelet with the distal end of the ribbon being captured between the disk and the clip. The clip having a length that is substantially equal to the radius of the disk so that the jaws of the clip to not extend beyond the rim of the disk. The ribbon is approximately one-half inch wide and twelve inches long with a three-quarter inch long section of a first portion of Velcro attached to the proximate end thereof and a mating section of Velcro affixed to the ribbon approximately four inches from the proximate end of the ribbon.

To capture an infant's mouth toy, the proximate end of the ribbon is inserted through the ring, or handle, of the toy and the two Velcro portions are brought together and closed on each other. To attach the device to the clothing of the infant, the clip is pinched with the clip opening placed to capture same portion of the infant's clothing.

CROSS REFERENCE

This application is related to a design patent application field the same day as this application by the same inventors. Said design patent application is entitled CLIP FOR USE WITH MOUTH TOY.

BACKGROUND OF THE INVENTION

This invention relates to an improved clip and cord combination for use with pacifiers or mouth toys for infants to prevent their loss or dirtying.

The trouble with mouth toys for infants, such as pacifiers and others, in the past, has been that they have been easily lost or rendered unsanitary. Once a pacifier or teether has been taken out of the mouth of the infant it is often thrown away by the infant, often far away, usually on the floor, sometimes elsewhere, and someone has to retrieve the pacifier or teether, wash it off and give it back to the infant or else there is an expression of unhappiness by the infant.

SUMMARY OF THE INVENTION

In the present invention, a holder assembly is provided for retaining a typical pacifier, or the like, to a baby's clothes. The assembly comprises a retaining ring at one end for capturing a ring attached to the pacifier, or the like. The retaining ring is connected to one end of an elongated plastic cord-like member having a sinusoidal or zig-zag configuration which provides enough flexibility so that it can be lengthened or shortened. The other end of the member incorporates a means for attachment to a clip which can be attached to the baby's clothes. The clip is provided with a suitable attractive design appearance.

Thus, the infant is free to use the pacifier, or the like, as much as desired but cannot lose it or throw it away, even when it has been taken out of the mouth of the infant or for any reasons is not held by the hands or the mouth of the infant.

DESCRIPTION OF A PREFERRED EMBODIMENT

Figure 1:
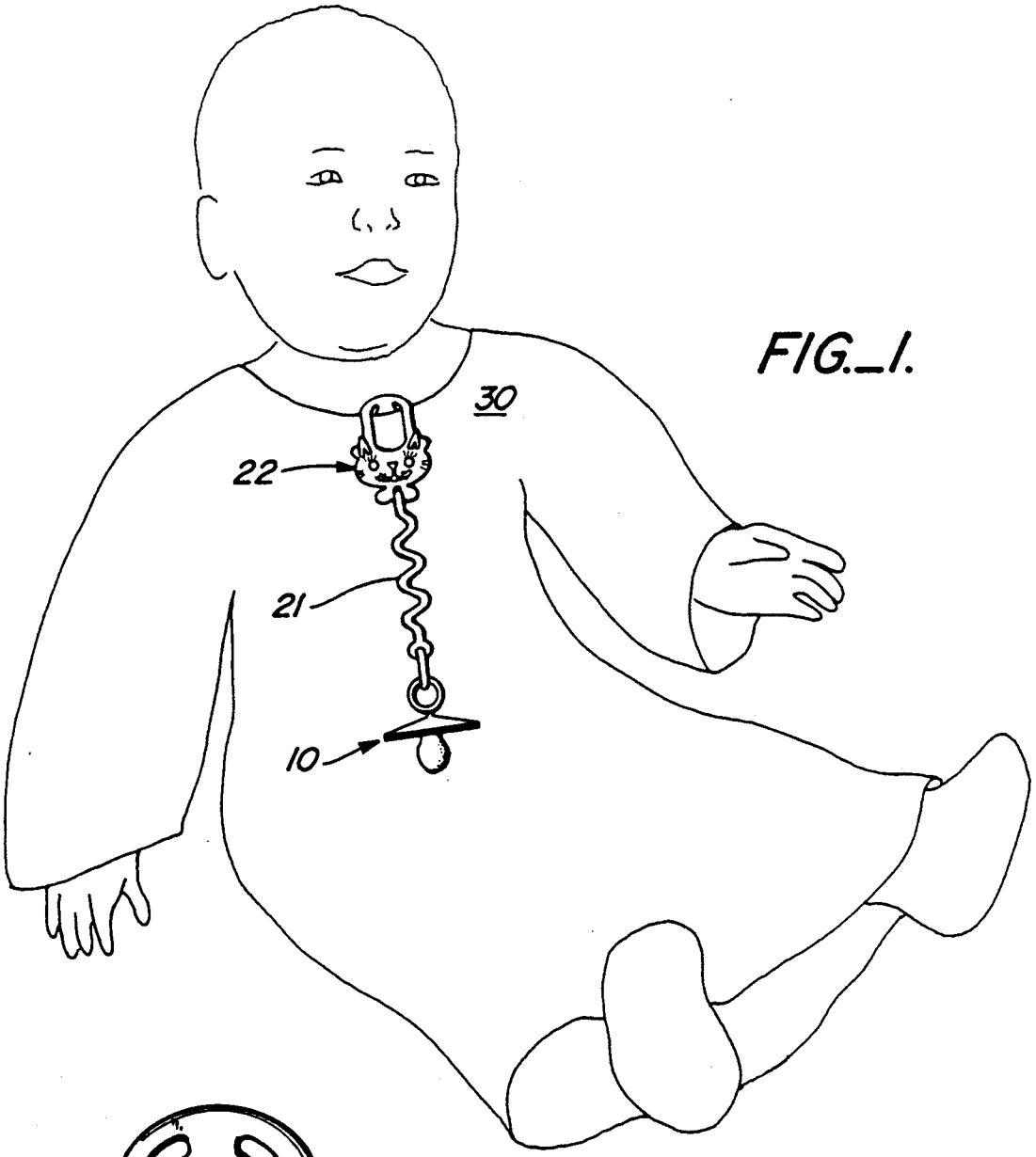
FIG. 1 is a view in perspective of a infant wearing some clothes, to which the clip for the mouth toy has been attached. The cord is shown in a kind of wavelike form so that it can be lengthened as well as shortened, and it is attached to the clip on one end and at the other end to a ring. The ring is thus attached to the ring of a mouth toy per se combination, the mouth toy being shown therebelow as a pacifier.
Figure 7:
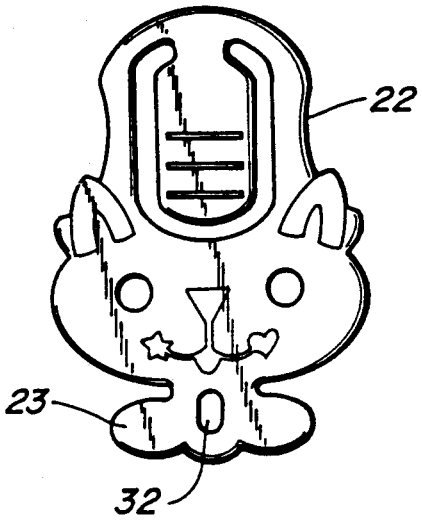
FIG. 7 is a plan view of the clip prior to being joined to the cord or the clothing of the infant.
Figure 2:
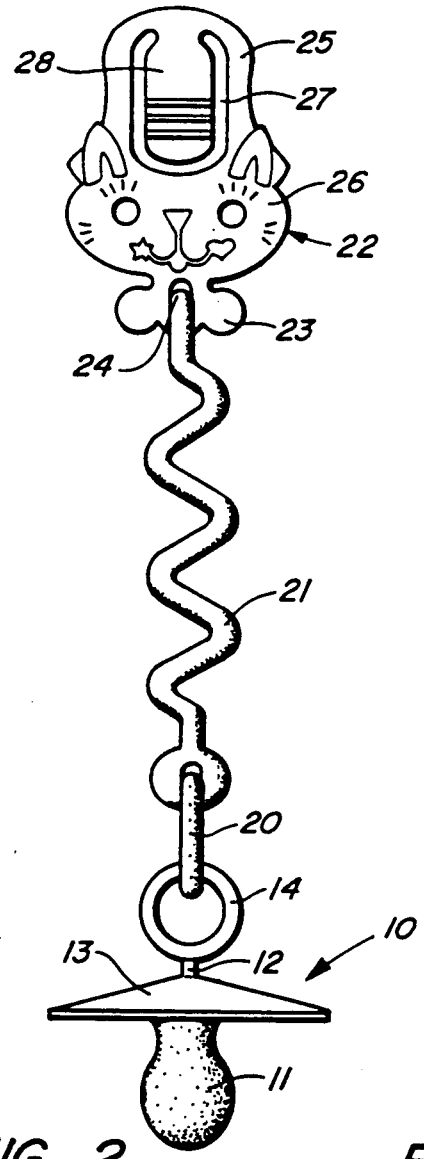
FIG. 2 is a view in front elevation of the combination of the clip, the cord, the rings, and a typical mouth toy.
Figure 3:
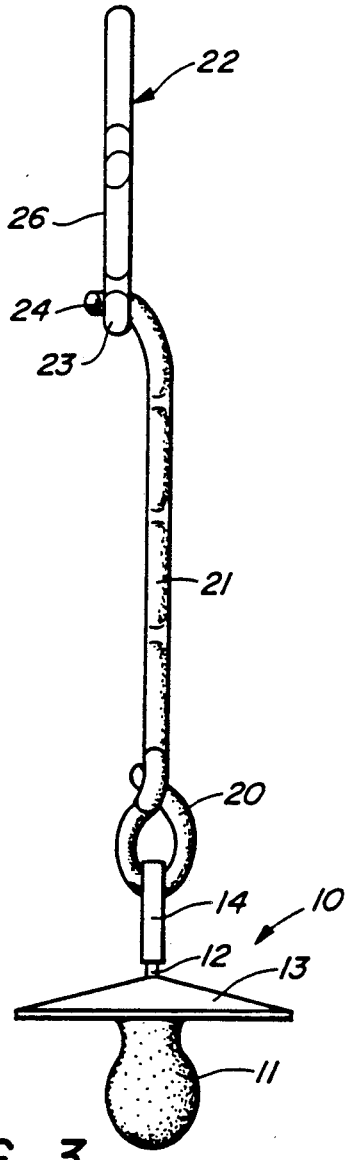
FIG. 3 is a similar view in side elevation.
Figure 6:
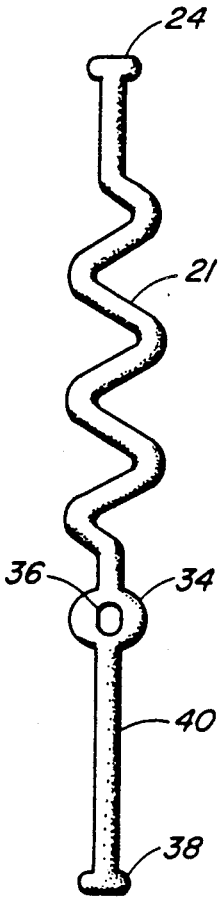
FIG. 6 is a plan view of the cord prior to being joined to the clip or to itself to capture the mouth toy.

The invention is used with any normal type of mouth toy 10. For purposes of illustration mouth toy 10 is shown as a typical pacifier having a squeezable ball-like portion 11 and a stem 12 at one end thereof. A conical protecting member 13 lies around the stem 12 and over and against the ball-like portion 11. There is also a ring member, or handle, 14 secured to the end of the stem 12 at the opposite end from the ball-like portion 11 of the pacifier combination 10.

All of the parts of this invention are made from non-toxic plastic, which is practically unbreakable. There is no metal or other part that could result in injury to the infant.

Ring 14 is attached to a plastic cord member 21 by means of a ring 20 on the proximate end of the plastic cord member 21. Cord member 21 is preferably made of a flexible plastic so that ring 20 can be formed by curling section 40 to bring a stub 38 at the proximate end of cord 21 toward an elongated hole 36 defined by ring 34. The handle 14 of the mouth toy 10 is placed over stub 38, then stub 38 is twisted through 95° to pass stub 38 through elongated hole 36. After passing through hole 36, stub 38 is released and is returned to its original position with its axis substantially orthaganol to the major axis of elongated hole 36. Thus, capturing the mouth toy 10 by ring 20. The cord 21 is preferably given a sinusoidal or wave-like shape through its central portion so that it can be lengthened as well as shortened. The cord 21 is thus freely extendable by pulling on either end and does not have anything that could hurt the infant or enable it to injure itself by biting.

Figure 4:
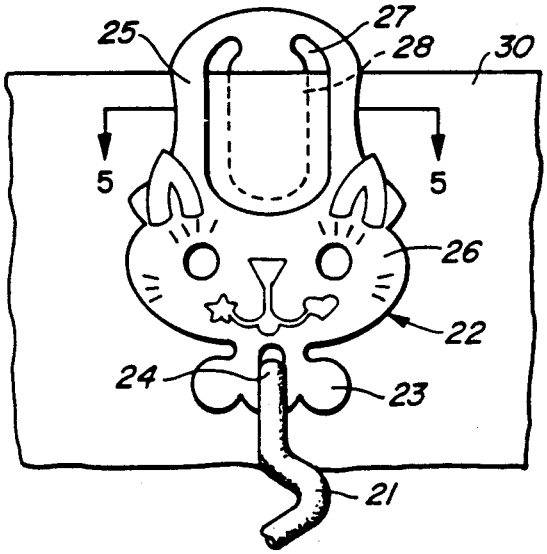
FIG. 4 is an enlarged portion of FIG. 2, showing how the clip is attached to a portion of the infant's clothes.
Figure 5:
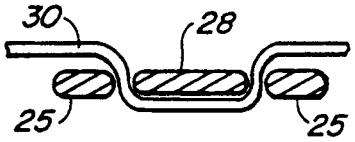
FIG. 5 is a view in section taken along the line 5—5 in FIG. 4.

The distal end of the cord member 21 is attached to a clip member 22. This done by providing a catch member 23 with an elongated hole 32 to hold a stub portion 24 of the distal end of the cord 21. The clip member 22 itself has an upper portion 25 that provides a structure somewhat like a plastic paper clip of suitable dimensions and a main body portion 26 between the catch 23, and the clip member 22. This main body portion 26 is preferably made with a shape and decoration to resemble a suitable animal in cartoon. Generally these are made attractive to infants. The clip member 22 is provided by a cutout opening 27 which resides on three sides of a tongue 28 of the clip 22 as shown in the drawings and can be spread apart from an outer marginal portion 25 of the clip member 22 and is fastened to a garment 30, as shown in FIGS. 1 and 4.

All these members are entirely made of plastic and are relatively soft although with enough rigidity to help retain it in place.

FIG. 1 shows the device of the present invention as worn by an infant who is not at the moment using the attached mouth toy. The parent can use his or her hand or hands to place mouth toy 10 in the infant's mouth at any time, and when the infant releases the mouth toy 10 from the mouth, mouth toy 10 simply falls and hangs down from the cord 21 as shown in this view. The clip 22 is clipped to a shirt or other similar article of the infant's clothing 30, and the combination of the mouth toy and the present invention is able simply to hang down from that article of clothing. No injury can come to the infant from using this combination, and there is no difficulty in finding it, because it is clipped to the infant's clothes 30 and is therefore always available, either to the infant or the parent or sitter who is watching the infant. This means that mouth toy 10 will not be lost or fall into awkward places from which recovery may become a chore.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A holder assembly for an infant pacifier, having a ring affixed thereto, said assembly comprising;

a plastic cord member having a general sinusoidal configuration and defining at its proximate end a flexible loop portion adapted to be attached to said ring of the pacifier in such a manner that it is difficult for an infant to open said loop portion;

a distal end portion on said cord member providing a connection means and including an enlarged stub portion; and a decorative plastic clip member attached to said connection means, said clip member having means which enable it to be clipped to the clothes of an infant so that the pacifier is retained on the infant during use, and an enlarged hole in said clip member for receiving said distal end portion and forming a releasable connection between the sinusoidal plastic cord member and the integral clip member.

2. The pacifier holder assembly of claim 1 wherein said clip member has a body portion representing an animal face.

3. The pacifier holder assembly of claim 1 wherein said cord member has an enlarged portion near its proximate end with an elongated opening and an enlarged stub portion at the tip of said proximate end, said stub portion being adapted to fit within said elongated opening when said flexible loop is formed through said pacifier ring.

4. A pacifier holder assembly for an infant, for retaining a pacifier having a first portion disposed to be placed in the infant's mouth, said first portion having a ring affixed thereto, said assembly comprising:

a sinusoidally shaped plastic cord member defining at its proximate end a loop portion adapted to be engaged by said ring of the pacifier so that it is difficult for an infant to open said loop portion;

a clip member connected to a distal end of said cord and adapted to be clipped to the clothes of an infant, said clip member further defining a catch portion having an elongated opening;

said cord having a distal end with a stub end portion which fits within said elongated opening of said catch portion on said clip member, whereby when the clip member is clipped to the clothes of an infant, the combination of the holder assembly and pacifier are retained from loss and from separation from the infant.

* * * * *